US006739796B1

(12) United States Patent
Del Nero et al.

(10) Patent No.: US 6,739,796 B1
(45) Date of Patent: May 25, 2004

(54) HIGH SECURITY MANHOLE INSERT COVER

(76) Inventors: Philip W. Del Nero, 13301 Springcreek Dr., Oklahoma City, OK (US) 73170; Kristin D. Del Nero, 13301 Springcreek Dr., Oklahoma City, OK (US) 73170

( * ) Notice: Subject to any disclaimer, the term of this patent is extended or adjusted under 35 U.S.C. 154(b) by 0 days.

(21) Appl. No.: 10/393,708

(22) Filed: Mar. 21, 2003

(51) Int. Cl.[7] ..... E02D 29/14
(52) U.S. Cl. ..... 404/25; 52/20
(58) Field of Search ..... 404/25, 26; 52/19, 52/20, 21

(56) References Cited

U.S. PATENT DOCUMENTS

| | | | | | |
|---|---|---|---|---|---|
| 911,256 | A | | 2/1909 | McWane | |
| 1,001,041 | A | | 8/1911 | Jones | |
| 1,458,391 | A | | 6/1923 | Burton | |
| 4,523,407 | A | * | 6/1985 | Miller | 49/465 |
| 4,919,564 | A | | 4/1990 | Neathery | |
| 5,082,392 | A | | 1/1992 | Marchese | |
| 5,328,291 | A | | 7/1994 | Wisniewski | |
| 5,827,007 | A | | 10/1998 | Barton | |
| 5,979,117 | A | * | 11/1999 | Fuller | 52/19 |
| 5,987,824 | A | | 11/1999 | Fuller | |
| 6,393,771 | B1 | | 5/2002 | Stetson | |
| 6,435,763 | B1 | * | 8/2002 | Sakane et al. | 404/25 |
| 6,488,440 | B1 | | 12/2002 | Hill | |

* cited by examiner

*Primary Examiner*—Thomas B. Will
*Assistant Examiner*—Alexandra K. Pechhold
(74) *Attorney, Agent, or Firm*—Randal D. Homburg

(57) ABSTRACT

The security manhole insert cover relates to a locking manhole insert to prevent ingress or egress to a manhole from above or below the manhole to prevent access to underground utilities, tunnels and underneath buildings and metropolitan areas to eliminate security intrusions and terrorist attacks by underground access, which would otherwise go undetected if access to the underground utility passages were not secured. The manhole insert cover has a cylindrical locking insert barring access to the engaging and disengaging mechanism required to remove the manhole insert cover and an integrated lower cover to prevent access to the engaging and disengaging mechanism from below, the insert cover adapted to fit within a manhole without required modification of the manhole and without detection of the insert cover having been installed from above ground levels.

4 Claims, 13 Drawing Sheets

HIGH SECURITY MANHOLE INSERT COVER

CROSS REFERENCE TO RELATED APPLICATIONS

None

I. BACKGROUND OF THE INVENTION

1. Field of Invention

The security manhole insert cover relates to a locking manhole insert to prevent ingress or egress to a manhole from above or below the manhole to prevent access to underground utilities, tunnels and underneath buildings and metropolitan areas to eliminate security intrusions and terrorist attacks by underground access, which would otherwise go undetected if access to the underground utility passages were not secured. The manhole insert cover has a cylindrical locking insert barring access to the engaging and disengaging mechanism required to remove the manhole insert cover and an integrated lower cover to prevent access to the engaging and disengaging mechanism from below, the insert cover adapted to fit within a manhole without required modification of the manhole and without detection of the insert cover having been installed from above ground levels.

2. Description of Prior Art

The following United States patents were discovered and are disclosed within this application for utility patent. All relate to locking hole covers.

A first series of prior art patents involve simple manhole inserts without disclosed locking mechanisms. Those two patents, U.S. Pat. No. 6,393,771 to Stetson and U.S. Pat. No. 4,919,564 to Neathery, disclose manhole inserts, Stetson merely providing a cover and ring which insert into a manhole and allow the insert to be filled with a road surfacing material to blend in with its surrounding roadway, the insert including at least two holes to allow water to pass through the insert. Neatherly is a sealed insert to prevent water intrusion into the manhole, with a pressure relief and vent access through the insert cover.

A second set of patents disclose manhole covers with locking devices, but not secure locking devices. Those patents include U.S. Pat. No. 911,256 to McWane, which discloses a meter box cover with a hinged lid that has a rotating closure means in the hinged lid, U.S. Pat. No. 1,001,041 to Jones, which discloses a rotating lock arm attached to a manhole cover which requires a key insertion to turn the rotating locking arm, and U.S. Pat. No. 1,458,391 to Burton, which has a turning handle that when lifted, provides a rotating force to rotate a cam to disengage two arms for removal of the manhole cover. Two more recent US patents, including U.S. Pat. No. 5,082,392 to Marchese and U.S. Pat. No. 5,987,824 to Fuller, involve more detailed mechanisms to engage and disengage their manhole covers to a hole or manhole, with Fuller having a threaded conical component that travels upward when rotated, forcing several locking wedges outward, anchoring the manhole cover to the hole by outward force, while Marchese involves spring loaded locking arms that require a rotating force to retract the spring loaded arms for removal of the manhole cover, the rotating force provided by a shaped key inserted into a respectively shaped keyhole.

A third set of US patents involve secure lock mechanisms to which padlocks are supplied as the securing component. These US Patents include U.S. Pat. No. 5,328,291 to Wisniewski, U.S. Pat. No. 5,827,007 to Barton and U.S. Pat. No. 6,488,440 to Hill. Hill defines a manhole cover having a molly-type locking arm that is engaged and disengaged by several turns of the rotating shaft, to which includes an upper eyelet through which a chain is padlocked to prevent unauthorized turning of the shaft. Barton includes a locking bar bolted to a manhole insert by a nut through which a strand is pulled and padlocked to prevent removal of the nut from an upward extending stud. Wisniewski is a manhole insert having a rotating cam mechanism having a hasp that is padlocked to a stationary hasp to prevent disengagement of the extending locking arms. All three of these may be removed by the use of bolt cutters, which takes little time and makes little noise during use to bypass the securing.

None of the above devices prevent access from and under side and none of the above devices include a similar locking means, nor do they furnish the secure locking means as disclosed in the current invention. While they may each bear some semblance to the current invention, they do not, either singularly or in combination, disclose the features of the current invention.

II. SUMMARY OF THE INVENTION

More so now than at any time in the past, public awareness of domestic threats of security are presented, with focus on areas that would allow operations out of the ordinary perception. As this awareness increases, so does the potential for security breaches in areas that are not conspicuous, primarily those underground in urban or high security areas. Access to underground utilities, tunnel systems that travel beneath buildings and underground mass transit systems is often had through manholes that are either in the streets or sidewalks, these manholes existing for decades. In lieu of replacing the existing manhole systems with other costly modified access means, a security insert for manholes which offers virtual impenetrable ingress and egress is provided in the security manhole insert cover for manholes, preventing the removal of the insert cover from either the top or bottom without required alteration of the manholes.

The primary objective of the invention is to provide a security manhole seal to prevent access to underground tunnels and utilities by the application of an insert which does not require alteration of the manhole or its cover.

A secondary objective of the invention is to provide the security manhole insert cover with a completely sealed cam lock which cannot be accessed from the top or the bottom without having a key operating a cylindrical lock that denies access to the cam lock and cannot be picked , pried or cut with a mechanical tool.

A third objective of the invention is to fabricate the insert cover out of a material which can not be damaged or removed without complex intervention, i.e., plasma cutting tools and explosives, which would alert the general public to the use of such bypass means to access the manhole before such access was had. In furtherance of this objective, the entire insert cover is made of stainless steel.

III. DESCRIPTION OF THE DRAWINGS

The following drawings are submitted with this utility patent application.

IV. DESCRIPTION OF THE PREFERRED EMBODIMENT

Figure 1:
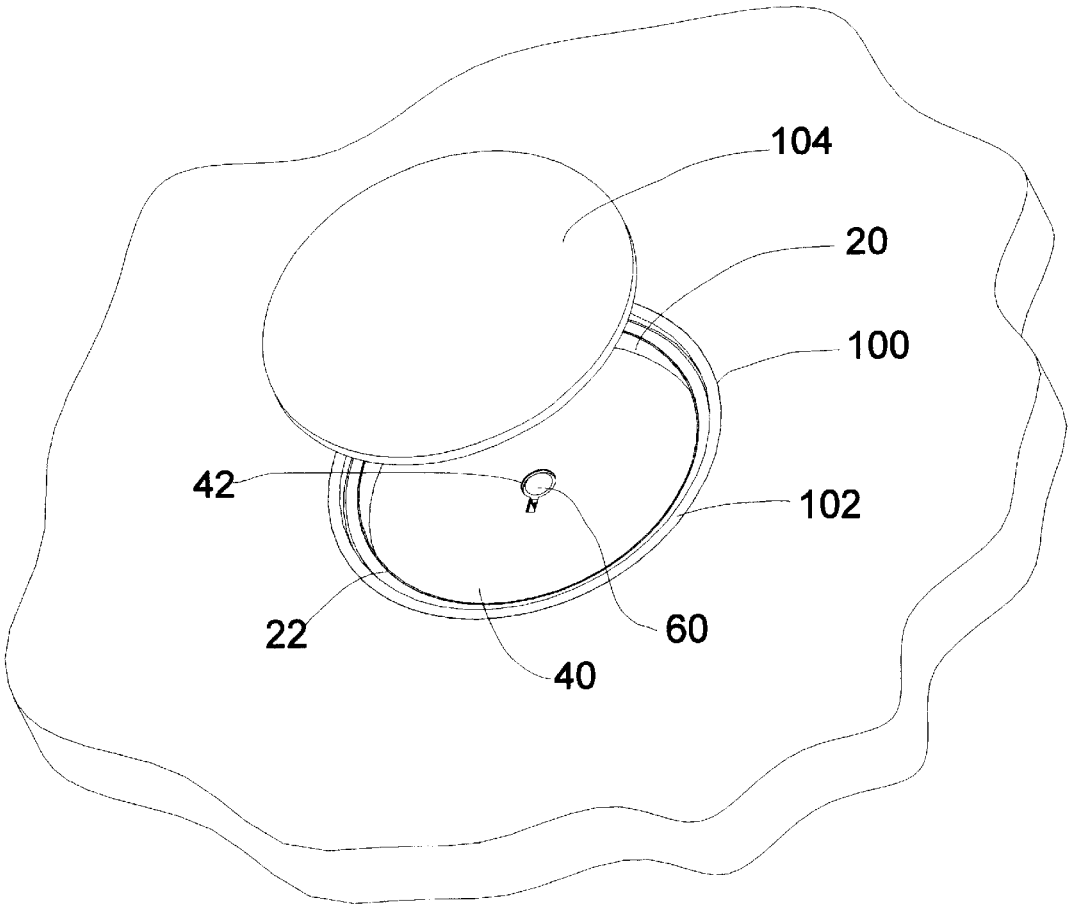
FIG. 1 is a perspective view of the insert cover in a manhole.
Figure 2:
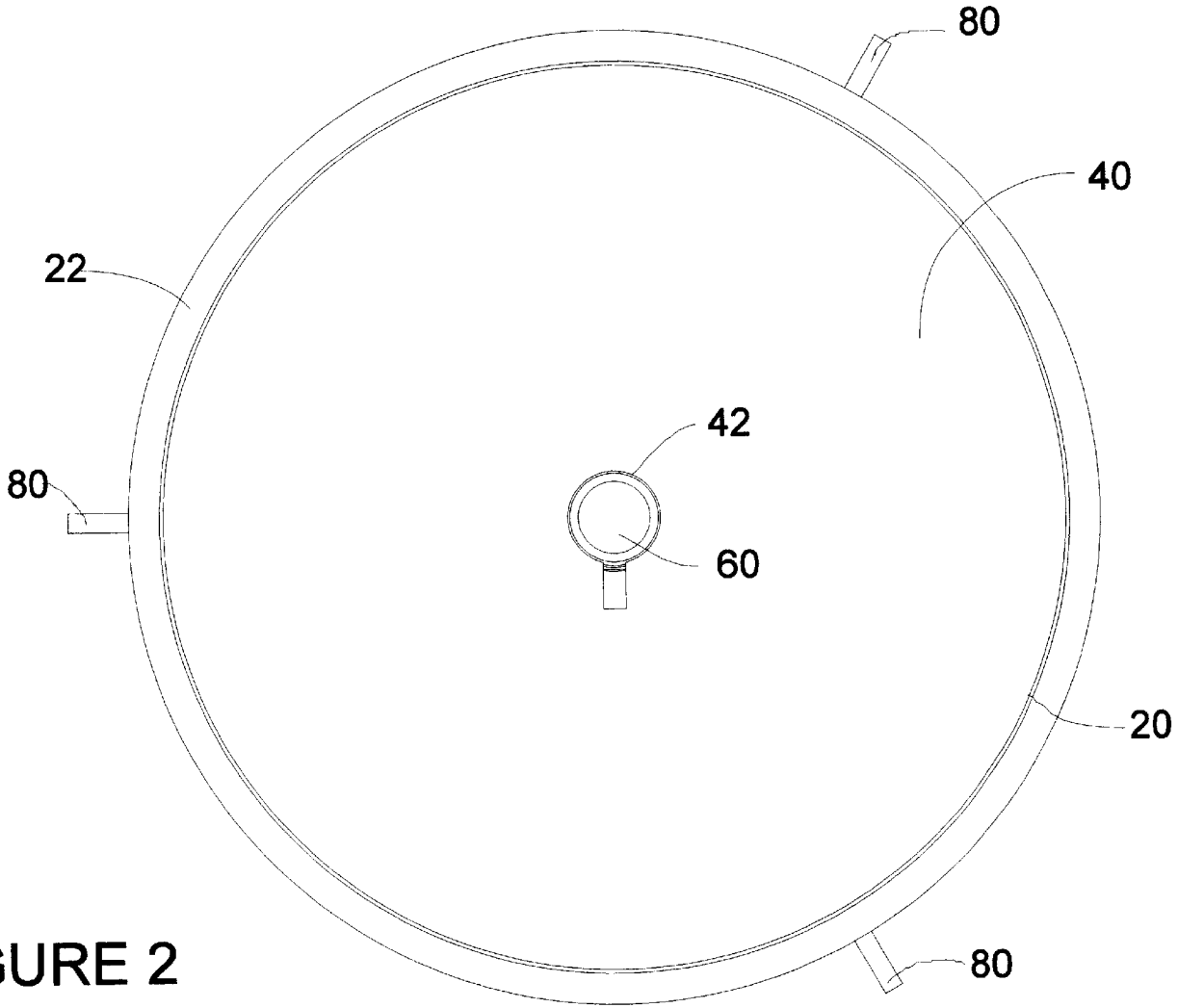
FIG. 2 is top view of the insert cover.

A high security manhole insert, shown in FIGS. 1–13 of the drawings, which requires no modification of an existing manhole 100, a manhole entrance 102 or a manhole cover 104, the manhole insert placed within the manhole entrance 102 to provide a high security blockade to ingress or egress to the manhole 100 from above and below, the high security manhole insert comprising essentially a circular perimeter rim 20 having an upper flange 22 upon which the manhole cover 104 is replaced after installation to the manhole entrance 102, a lower plate 30 connected to the perimeter rim 20, an upper plate 40 also attached to the perimeter rim 20 above the lower plate 30, with the perimeter rim 20, the upper plate 40 and the lower plate 30 defining an inner cavity 50 within which is placed a rotatable locking means 70 having a central slot 72, receiving a slot key 74, a plurality of extendable locking arms 80 extending through the perimeter rim 20 extended by the rotation of the rotatable locking means 70, the lower plate 30 preventing any access to the rotatable locking means 70 from below and the upper plate 40 limiting the slot key 74 access to the central slot 72 of the rotatable locking means 70 through a recessed cylindrical access hole 42 having a cylindrical lock housing 44 in said upper plate 40, the cylindrical lock housing 44 adapted to accept a cylindrical lock 60 having a vertical locking member 62, the cylindrical lock 62 requiring a key.

More specifically and most preferably, the entire manhole insert is made of stainless steel or other high strength metal product requiring use of at least a plasma torch to penetrate the manhole insert. The circular perimeter rim 20 is adapted to fit securely within a manhole entrance 102, shown in FIG. 1 of the drawings, the circular perimeter rim 20 having a plurality of locking arm holes 24 to allow the locking arms 80 to traverse the perimeter rim 20. The upper flange 22 is adapted to fit within the manhole entrance 102 underneath the manhole cover 104, resting above the manhole entrance 102, while positioning each locking arm hole 24 below the manhole entrance 102, locking the manhole insert to the manhole entrance 102.

Figure 3:
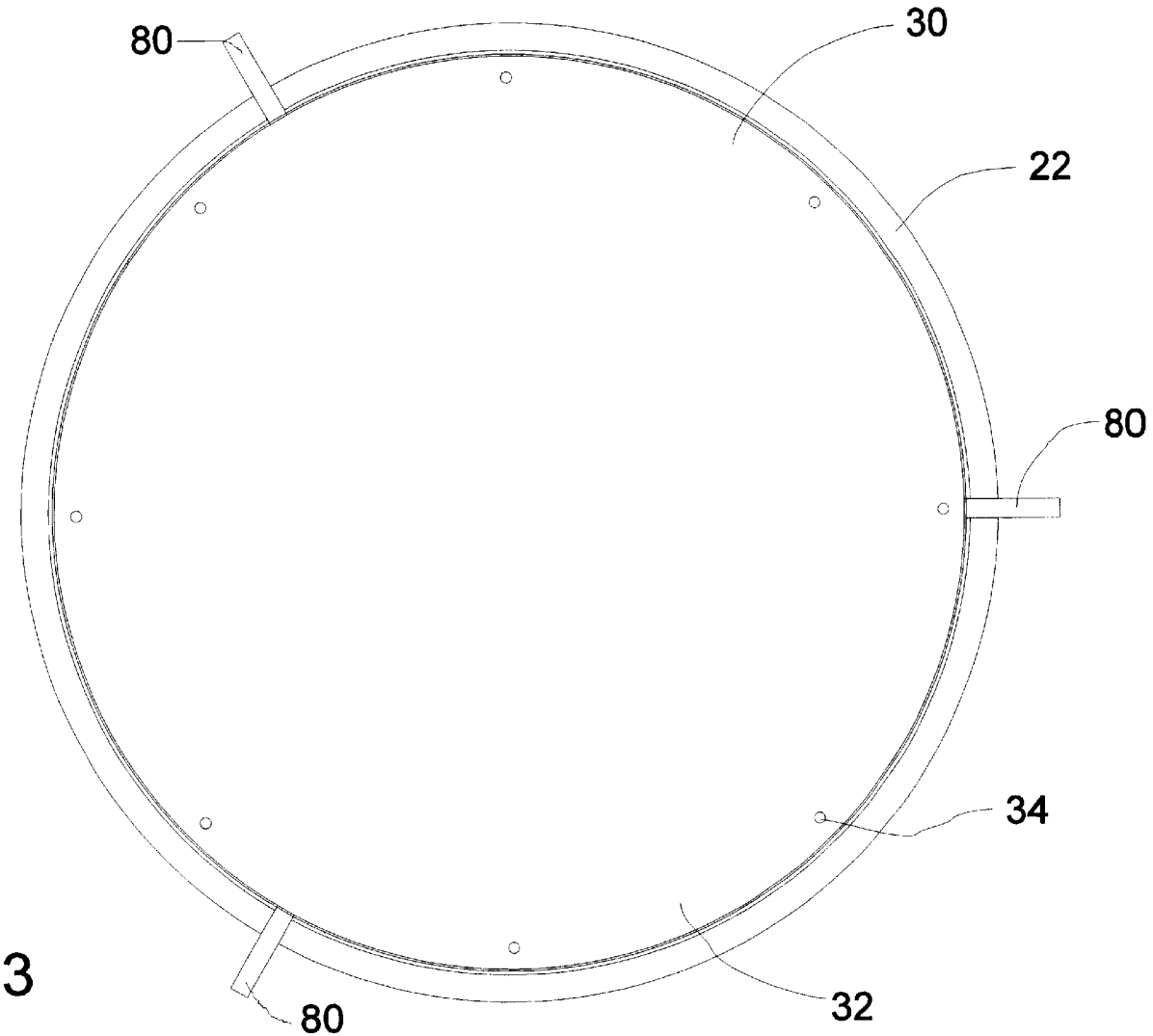
FIG. 3 is an underside view of the insert cover.
Figure 4:
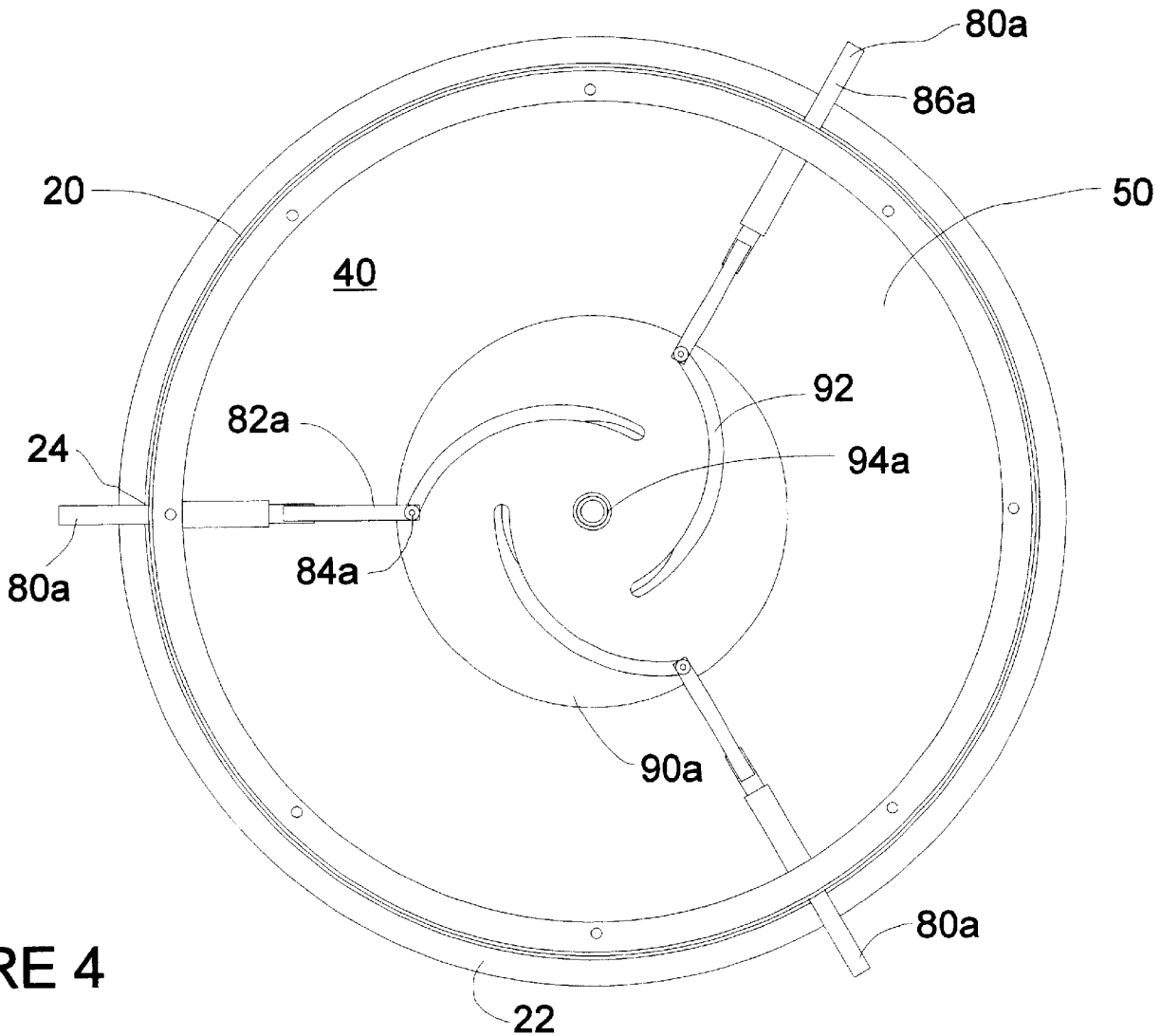
FIG. 4 is an underside inner view of a first embodiment of the insert cover with the lower plate removed.

The lower plate 30 is preferably slightly concave, which allows for water intruding into the inner cavity 50 to collect and pool in an outer portion 32 of the lower plate 30, where at least one drain hole 34 would be provided. The upper plate 40 may be flat or slightly concave and includes the recessed cylindrical access hole 42, shown in FIGS. 1, 2 and 5, which is aligned with the central slot 72 in the rotatable locking means 70 to lock and unlock the manhole insert for attachment and removal. The attachment of the upper plate 40 to the perimeter rim 20 is most preferably by welding, but the attachment of the lower plate 30 to the perimeter rim 20 may be by rivet, welding or bolting, as shown in FIG. 3.

The rotatable locking means 70 is shown as two embodiments in the drawings. In the first embodiment, shown in FIGS. 4, 5, 7 and 8, the rotatable locking means 70 is a spiral cam 90*a* having a plurality of spiral slots 92 machined in the spiral cam 90*a* with a central hole 94*a*. This spiral cam 90*a* is attached to the lower plate 30 by a cam support pedestal 76, FIG. 5, having a central shaft 78 extending upward from the lower plate 30 engaging the central hole 94*a*. Attached above the central hole 94*a*, further attached to the spiral cam 90*a* is the central slot 72, also FIG. 5. The spiral cam 90*a* is thus rotated by turning the inserted slot key 74, FIG. 12 within the central slot 72 rotating the spiral cam 90*a* clockwise and counter clockwise. A plurality of extendable first locking arms 80*a* connect within the spiral slots 92 by cam bearings 84*a* positioned on a first end 82*a* of the first locking arms 80*a*, FIG. 8, which allow the first end 82*a* of the first locking arms 80*a* to move freely within the spiral slots 92. A second end 86*a* of the first locking arms 80*a* extends through the locking arm holes 24 of the perimeter rim 20, FIG. 6. As the spiral cam 80*a* is turned, the first locking arms 80*a* are either urged inward or outward from the perimeter rim 20 to lock and unlock the manhole insert from the manhole entrance 102. A slight taper is preferred on the second end 86*a* of the first locking arms 80*a*.

Figure 5:
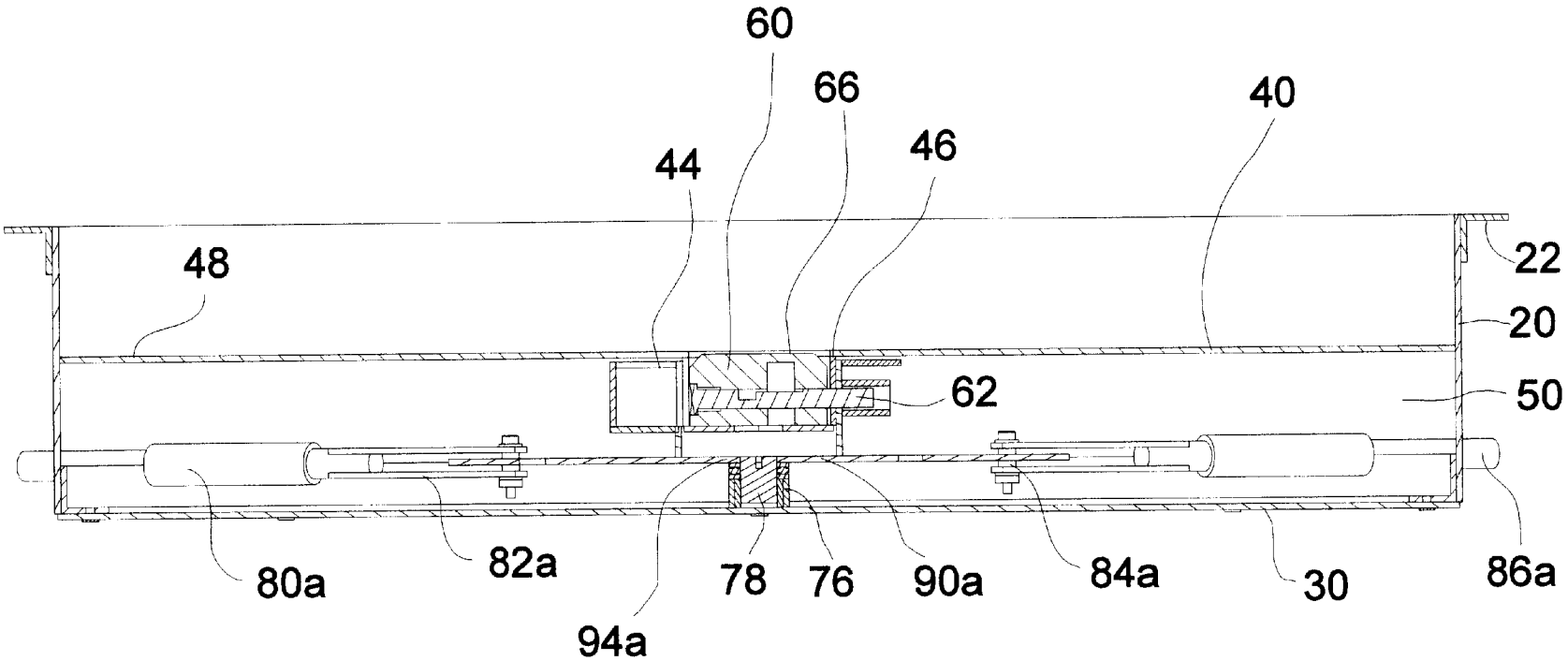
FIG. 5 is a side cross section of the insert cover using a first embodiment of the rotatable locking means.
Figure 6:
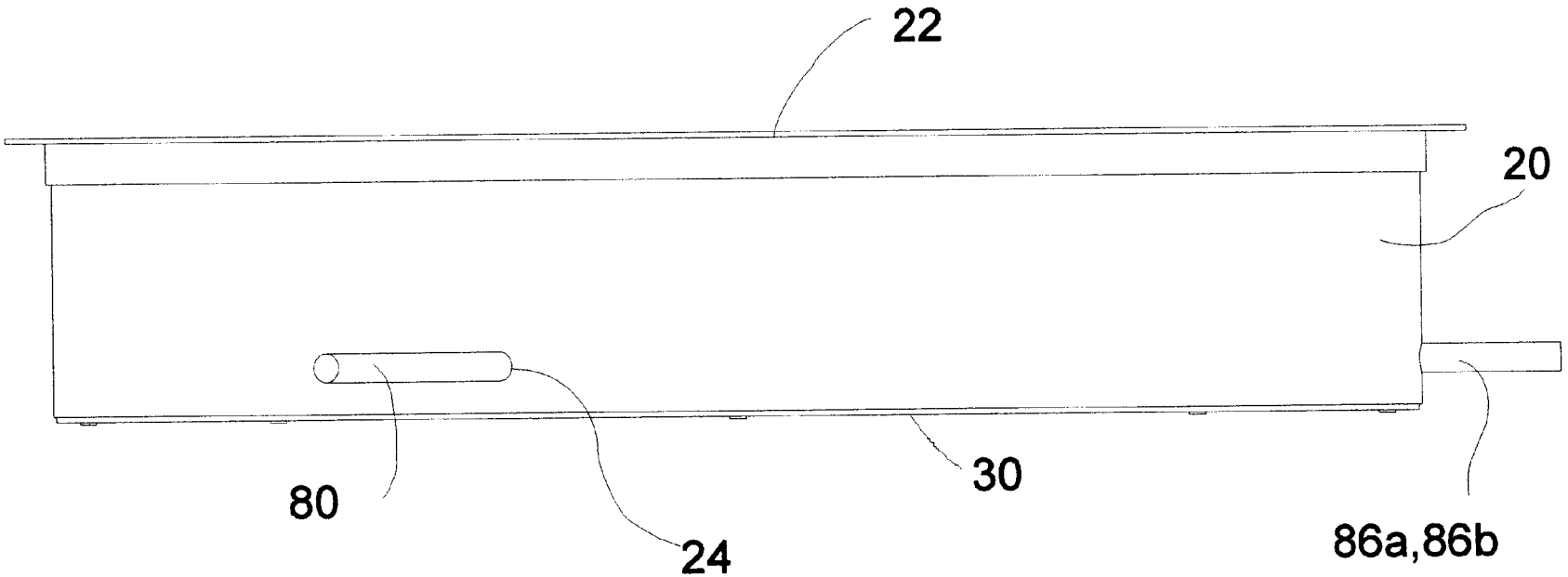
FIG. 6 is a side view of the insert cover.
Figure 7:
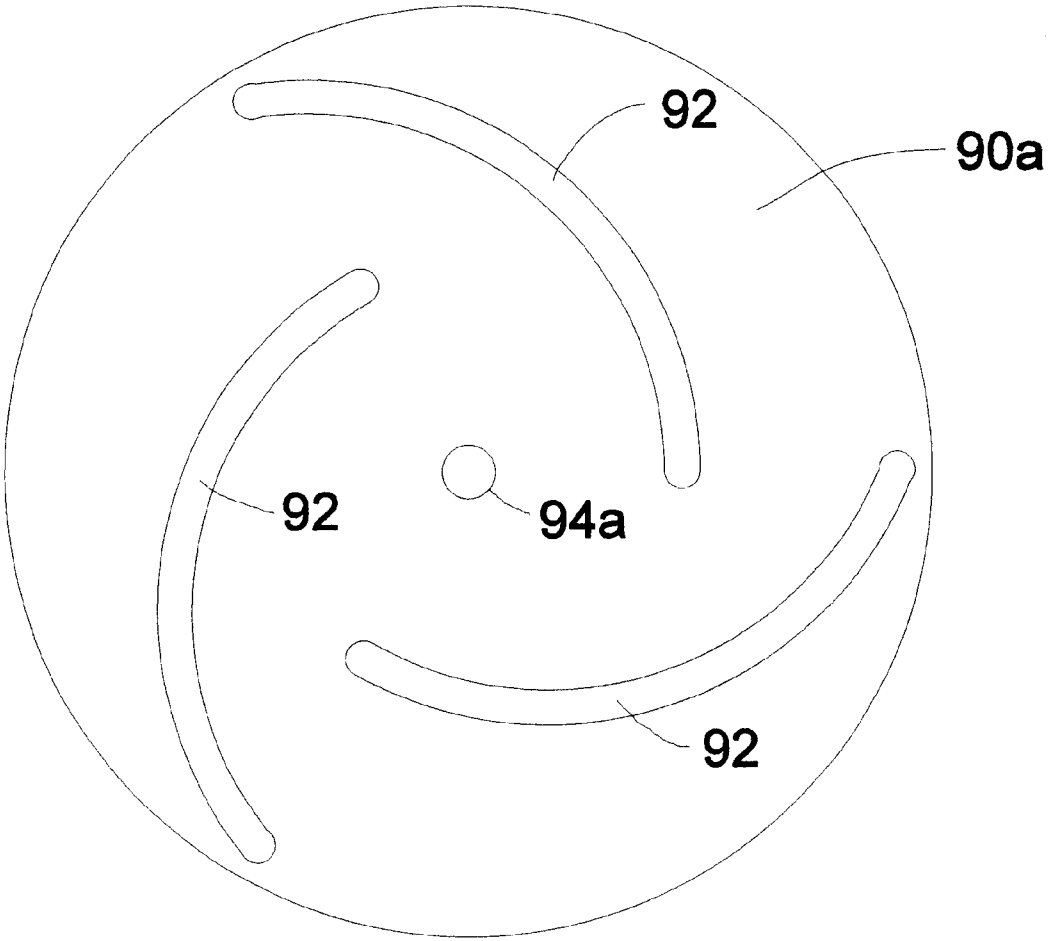
FIG. 7 is a top view of the spiral cam wheel of the first embodiment of the insert cover.
Figure 8:
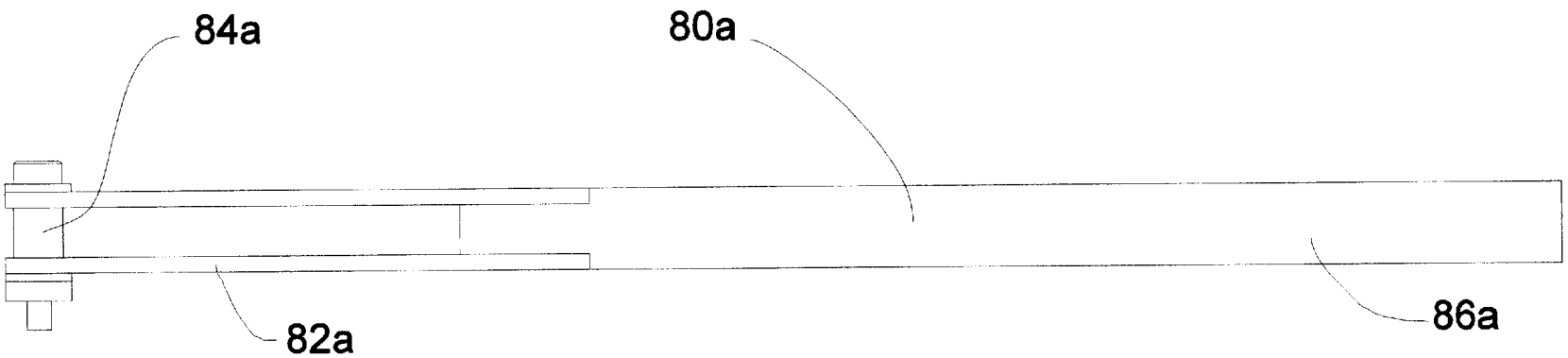
FIG. 8 is a side view of the locking arm which engages the spiral cam wheel.

Positioned above the central slot 72 and central hole 94*a* of the spiral cam 90*a* is a cylindrical lock housing 44 below the recessed cylindrical access hole 42 in the upper plate 40, FIG. 5. This cylindrical lock housing 44 is adapted to receive the cylindrical lock 60 and the vertical locking member 62, FIGS. 5 and 11. The cylindrical lock housing 44 allows for the insertion of the cylindrical lock 60 and with a slight rotation, the cylindrical lock housing 44 having a locking hole 46 through which the vertical locking member 62 of the cylindrical lock 60 may extend, locks the cylindrical lock 60 within the cylindrical lock housing 44, completely blocking all access to the central slot 72 and the spiral cam 90*a* below. This cylindrical lock 60 cannot be cut by bolt cutters and should be comprised of a strong metal, preferably a high carbon steel. The cylindrical lock 60 includes an upper surface 66 which should lie flush with an upper surface 48 of the upper plate 40 when said cylindrical lock 60 is locked within cylindrical lock housing 44. Most suited for application as the cylindrical lock 60 is the AMERICAN LOCK® 2500 Series Padlock.

Figure 9:
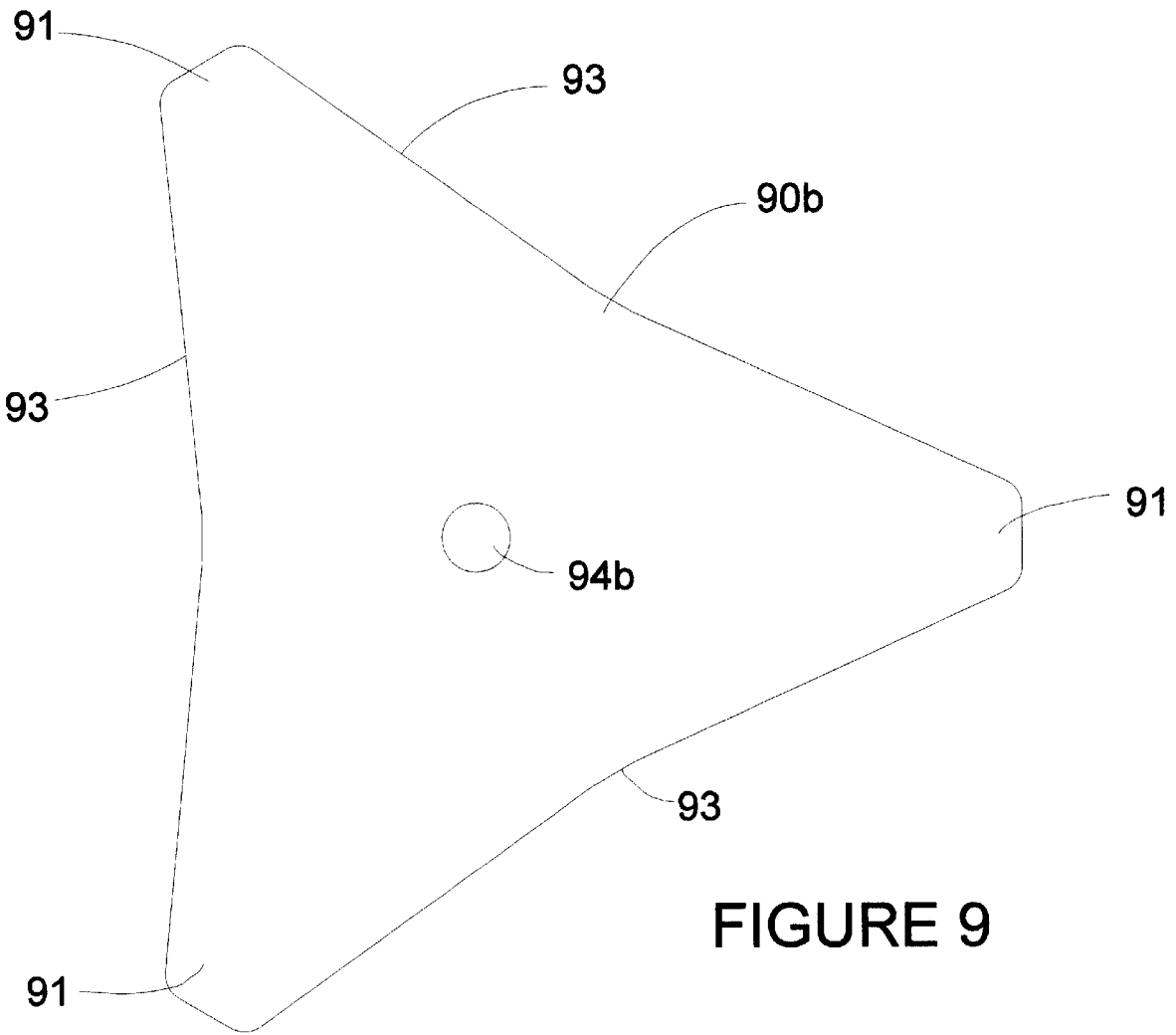
FIG. 9 is a top view of the flanged cam wheel of the second embodiment of the insert cover.
Figure 10:
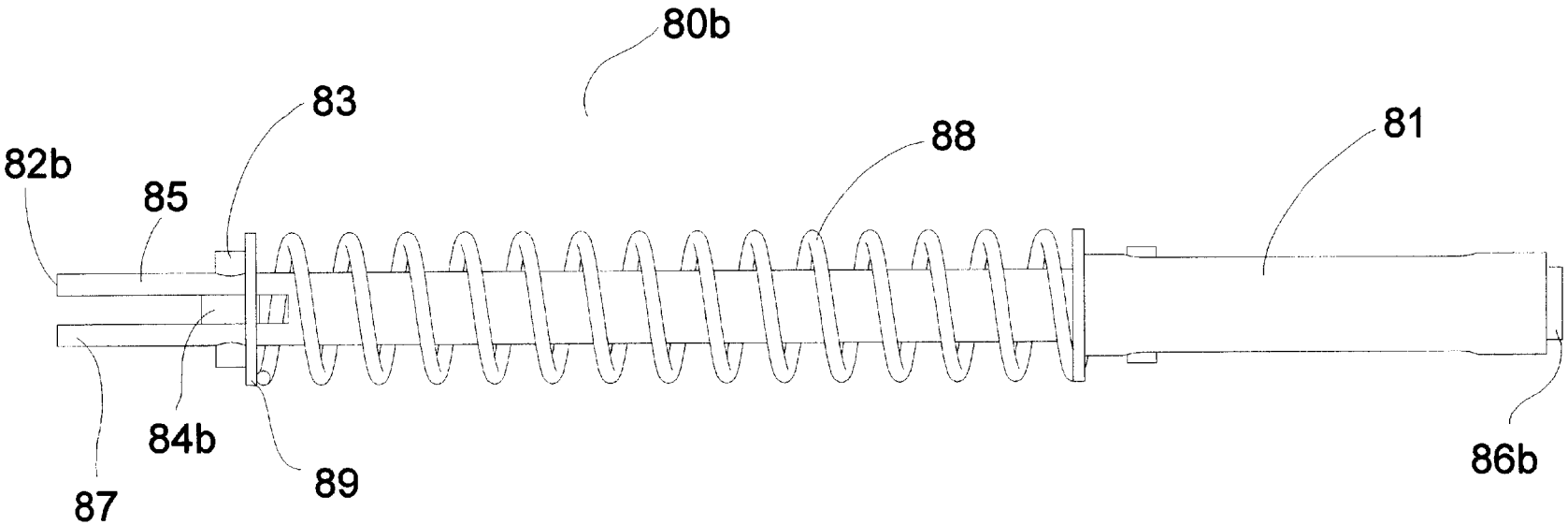
FIG. 10 is a side view of the locking arm which engages the flanged cam wheel.

In a second embodiment of the manhole insert, shown in FIGS. 9–13, the rotatable locking means 70 is provided by a flanged cam 90*b*, FIG. 9, having a plurality of extending flanges 91 incorporated into an outer perimeter 93 of the flanged cam 90*b*, said flanged cam 90*b* having a central hole 94*b*. This flanged cam 90*b* is also attached to the lower plate 30 by a cam support pedestal 76 having a central shaft 78 extending upward from the lower plate 30 engaging the central hole 94*b*, FIG. 11. Attached above the central hole 94*b*, further attached to the flanged cam 90*b* is the central slot 72. The flanged cam 90*b* is thus rotated by turning the inserted slot key 74 within the central slot 72 rotating the flanged cam 90*b* clockwise and counter clockwise, FIG. 12.

Figure 11:
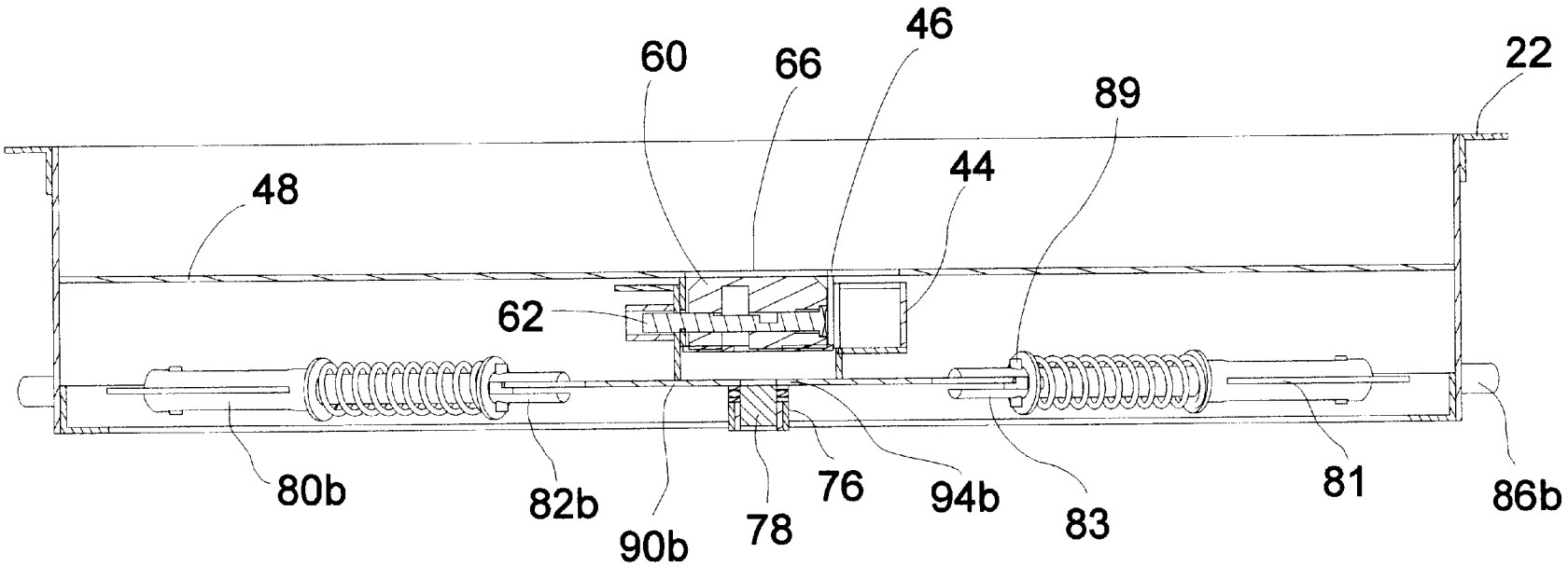
FIG. 11 is a side cross section of the insert cover with the second embodiment of the rotatable locking means.
Figure 12:
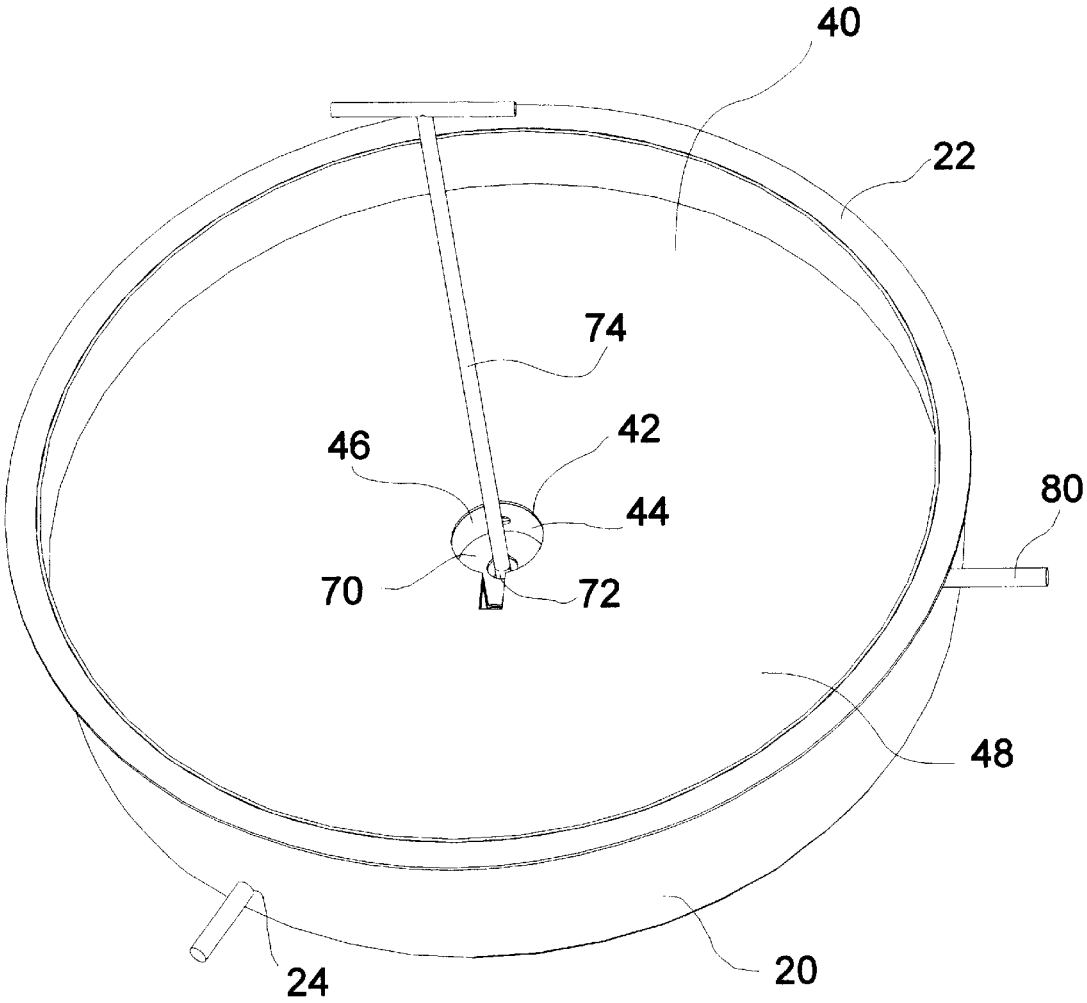
FIG. 12 is a view of the slot key in the central slot.
Figure 13:
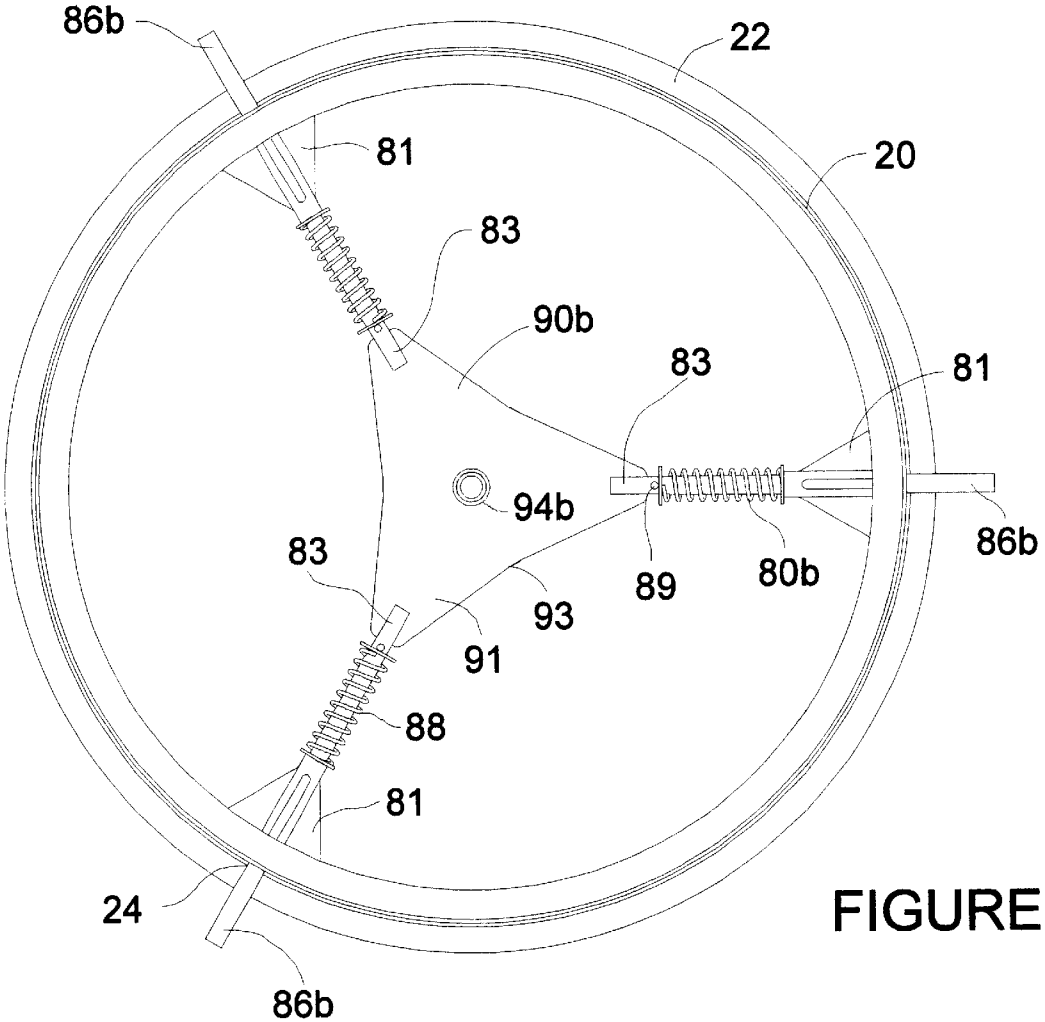
FIG. 13 is an underside inner view of the second embodiment of the insert cover with the lower plate removed.

In this second embodiment, a plurality of second locking arms 80*b* are not directly connected to the flanged cam 90*b*, but each second locking arm 80*b* slideably engages a support bracket 81 attached to the perimeter rim 20, aligned with the locking arm holes 24, FIGS. 11 and 13. Each second locking arm 80*b*, FIG. 10, includes a first end 82*b* having a cam buttress 83 which abuts the outer perimeter 93 of the flanged cam 90*b* as it is turned, this cam buttress 83 including a cam bearing 84*b*, an upper stabilizer plate 85 and lower stabilizer plate 87, the upper and lower stabilizer plates 85, 87 maintaining the cam buttress 83 against the flanged cam 90*b* while the cam bearing 84*b* rides smoothly against the outer perimeter 93 of the flanged cam 90*b*. Also included on each second locking arm 80*b* is a spring 88, FIGS. 10 and 13, retained on the second locking arm 80*b* between a pin 89 and each support bracket 81, wherein the spring 88 urges the second locking arm 80*b* against the flanged cam 90*b*. A second end 86*b* of the second locking arm 80*b* extends through each support bracket 81 and through the locking arm holes 24 of the perimeter rim 20, also FIG. 6. As the flanged cam 90*b* is rotated, the second locking arms 80*b* are urged outward or retract inward from the perimeter rim 20 to lock and unlock the manhole insert from the manhole entrance 102. A slight taper is preferred on the second end 86*b* of the second locking arms 80*b*.

Also positioned above the central slot 72 and central hole 94*b* of the flanged cam 90*b* is the same cylindrical lock housing 44 below the recessed cylindrical access hole 42 in the upper plate 40 as was provided with the first embodiment including the spiral cam 90*a*. This cylindrical lock housing 44 also is adapted to receive the cylindrical lock 60 and the vertical locking member 62. The cylindrical lock housing 44 allows for the insertion of the cylindrical lock 60 and a slight rotation, the cylindrical lock housing 44 having a locking hole 46 through which the vertical locking member 62 of the cylindrical lock 60 may extend to lock the cylindrical lock 60 within the cylindrical lock housing 44, completely blocking all access to the central slot 72 and the flanged cam 90*b* below. This cylindrical lock 60 also cannot be cut by bolt cutters and should be comprised of a strong metal, preferably a high carbon steel. The cylindrical lock 60 includes the upper surface 66 which should lie flush with the upper surface 48 of the upper plate 40 when said cylindrical lock 60 is locked within the cylindrical lock housing 44. Again, most suited for application as the cylindrical lock 60 is the AMERICAN LOCK® 2500 Series Padlock.

While the invention has been particularly shown and described with reference to a preferred embodiment thereof, it will be understood by those skilled in the art that changes in form and detail may be made therein without departing from the spirit and scope of the invention.

What is claimed is:

1. A high security manhole insert requiring no adaptation to an existing manhole, a manhole entrance or a manhole cover, the manhole insert placed within the manhole entrance to provide a high security blockade to ingress or egress to the manhole from above and below, the high security manhole insert comprising essentially:

a circular perimeter rim having an upper flange upon which the manhole cover is replaced after installation of the manhole insert to the manhole entrance;

a lower plate connected to the perimeter rim;

an upper plate having a recessed cylindrical access hole including a cylindrical lock housing, said upper plate attached to the perimeter rim above the lower plate, with the perimeter rim, the upper plate and the lower plate further defining an inner cavity, within which is placed;

a rotatable locking means having;

a central slot, activated by a slot key, a plurality of extendable locking arms extending through the perimeter rim, said extendable locking arms extended by the rotation of the rotatable locking means, wherein the lower plate prevents access to the rotatable locking means from below while the upper plate limits access to the rotatable locking means through the recessed cylindrical access hole in said upper plate, said cylindrical lock housing adapted to accept a cylindrical lock having a vertical locking member, said cylindrical lock including an upper surface which should lie flush with an upper surface of the upper plate when said cylindrical lock is locked by a key within said cylindrical lock housing, the entire manhole insert comprised of a high strength metallic composition.

2. The manhole insert, as disclosed in claim 1, further comprising:

the rotatable locking means including;

a spiral cam having a plurality of spiral slots machined in the spiral cam with a central hole, said spiral cam attached to the lower plate by a cam support pedestal having a central shaft extending upward from the lower plate engaging the central hole of the spiral cam, further attached to the central slot;

a plurality of extendable first locking arms connecting within the spiral slots by cam bearings positioned on a first end of said first locking arms, the first end of the first locking arms moving within the spiral slots while a second end of the first locking arms extends through the locking arm holes of the perimeter rim; and the cylindrical lock housing below the recessed cylindrical access hole in the upper plate, said access hole adapted to receive the cylindrical lock and the vertical locking member, wherein said cylindrical lock housing engages the cylindrical lock, said cylindrical lock housing having a locking hole through which the vertical locking member of the cylindrical lock may extend, after rotation of the cylindrical lock, to secure the cylindrical lock within the cylindrical lock housing, blocking all access to the central slot and the spiral cam below.

3. The manhole insert, as disclosed in claim 1, further comprising:

the rotatable locking means including;

a flanged cam having a plurality of extending flanges, an outer perimeter and a central hole, said flanged cam attached to the lower plate by a cam support pedestal having a central shaft extending upward from the lower plate engaging the central hole of the flanged cam, further attached to the central slot;

a plurality of second locking arms slideably engaging the perimeter rim by a support bracket per each said second locking arm, said second locking arms, having;

a first end including a cam buttress abutting the outer perimeter of the flanged cam as said flanged cam is turned, said cam buttress further including a cam bearing, an upper stabilizer plate and lower stabilizer plate, said upper stabilizer plates and lower stabilizer plates maintaining said respective cam buttress against said outer perimeter of said flanged cam;

a spring retained on said second locking arm between a pin and each said support bracket, wherein said spring urges said second locking arm against said flanged cam; and a second end extending through said support bracket and through said locking arm holes of the perimeter rim, wherein said second locking arms are urged outward or retract inward from the perimeter rim to lock and unlock the insert to from the manhole entrance; and a cylindrical lock housing below the recessed cylindrical access hole in the upper plate, said access hole adapted to receive the cylindrical lock and the vertical locking member, wherein said cylindrical lock housing engages the cylindrical lock, said cylindrical lock housing having a locking hole through which the vertical locking member of the cylindrical lock may extend, after rotation of the cylindrical lock, to secure the cylindrical lock within the cylindrical lock housing, blocking all access to the central slot and the flanged cam below.

4. The manholes insert, as disclosed in claim 1, wherein the high strength metallic composition is stainless steel.

* * * * *